US005426793A

United States Patent [19]

Mac

[11] Patent Number: 5,426,793

[45] Date of Patent: Jun. 27, 1995

[54] REFRESHABLE FRAGRANT CUSHIONED TOILET SEAT

[76] Inventor: Andrew C. Mac, 33 Rue Chanez, Paris, France, 75016

[21] Appl. No.: 101,991

[22] Filed: Aug. 4, 1993

[51] Int. Cl.[6] ..... A47K 13/00

[52] U.S. Cl. ..... 4/237; 4/234; 4/242.1

[58] Field of Search ..... 4/228.1, 234, 237, 242.1

[56] References Cited

U.S. PATENT DOCUMENTS

| | | | |
|---|---|---|---|
| 2,016,412 | 10/1935 | Winding | 4/234 |
| 2,114,551 | 4/1938 | Winding | 4/237 |
| 2,155,286 | 4/1939 | Winding | 4/234 |
| 2,899,689 | 8/1959 | Pastl | 4/237 |
| 3,068,492 | 12/1962 | Price . | |
| 3,484,876 | 12/1969 | Thomas | 4/234 |
| 3,659,296 | 5/1972 | Stamper | 4/229 |
| 3,914,805 | 10/1975 | Dolan | 4/228.1 |
| 4,064,573 | 12/1977 | Calderone | 4/228.1 |
| 4,155,127 | 5/1979 | Seiderman | 4/234 |
| 4,212,089 | 7/1980 | Lindauer | 4/228.1 |
| 4,344,194 | 8/1982 | Pearson | 4/229 |
| 5,086,523 | 2/1992 | Demott | 4/229 |

*Primary Examiner*—Charles E. Phillips
*Attorney, Agent, or Firm*—Edward J. Kaliski

[57] ABSTRACT

A refreshable fragrant cushioned toilet seat (100) releases air freshener (26) concealed in its interior cushioning (20) through holes (16) in the upper panel (10) or the lower panel (12) or both into the toilet area on a continuous basis to eliminate odorous air in the toilet area. Upon exhaustion of the air freshener (26) in the toilet seat (100), the air freshener (26) is replenished by impregnating the holes with air freshener (26) dispensed from a container (22) with an acicular head (24). This acicular head (24) is of selected length and penetrates through the holes (16) into the interior of the cushion (20) where air freshener (26) is deposited. In another embodiment, the holes (16) penetrate into a cavity (32) in the upper panel (10) of the toilet seat (100) which is filled with air-refreshening potpourri (33) and covered with a transparent lid (34) flush with the top of this panel. This embodiment provides a pleasing aspect to the eye as well as serving the replenishable, air freshening function. The toilet seat (100) and the container holding air freshener (22) with the acicular head (24) may be sold as a kit for modifying existing toilets.

7 Claims, 6 Drawing Sheets

Fig- 15
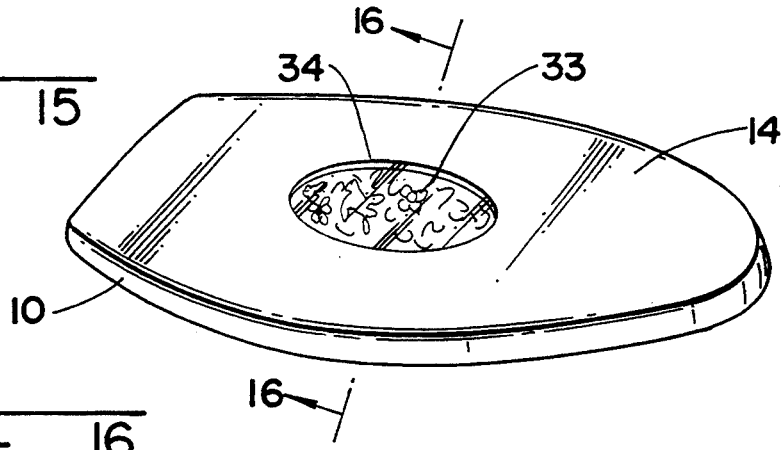
Fig- 16
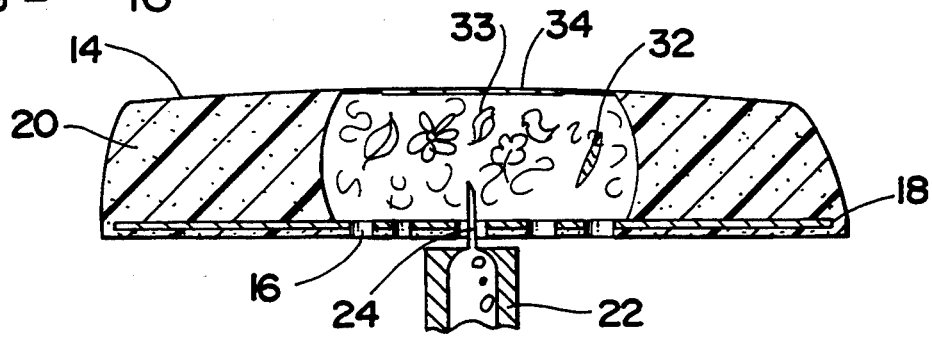
Fig- 17
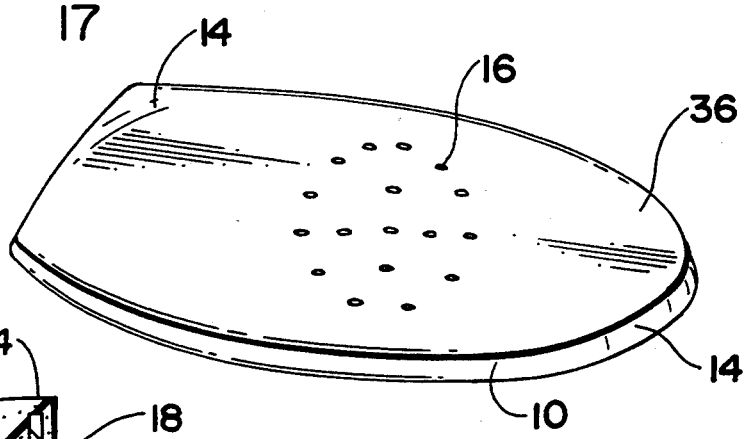
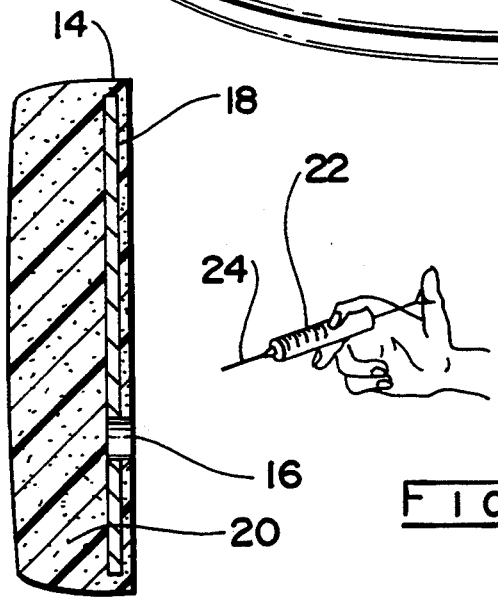
Fig- 18

REFRESHABLE FRAGRANT CUSHIONED TOILET SEAT

BACKGROUND OF THE INVENTION

1. Field of the Invention

This invention relates to a toilet seat and specifically to a cushioned toilet seat which contains means to appeal to the senses of the user and more specifically contains an air freshener concealed in the seat which refreshes the toilet vicinity on a continuous basis and optionally has visual as well as olfactory appeal.

2. Description of the Prior Art

Numerous efforts have been made in the past to solve the problem of odor laden air in the toilet area and any number of devices have been tried to produce a pleasing smell in the toilet area. These devices and efforts have ranged from liquid dispensers, to electronic odor neutralizers, aerosol sprays that operate on timed cycles, and apparatus connected to a flush tank or toilet seat. U.S. Pat. No. 4,344,194 issued Aug. 17, 1982 to Raymond H. Pearson discloses a toilet seat and lid with a concealed air ventilating and deodorizing device which is battery operated, and which operates when the weight responsive operator is actuated, due to the weight of a person on the toilet seat. In turn this allows the fan to be turned on by actuating the manually operated operator. The fan turns off when pressure is released from the toilet seat. A disadvantage of this invention is that the fan will not turn on in response to the operation of only one of the operators wherein a person may forget to switch on the fan.

U.S. Pat. No. 3,659,296 to Stamper has the disadvantage that batteries, or an external low voltage, is used to energize a fan to eliminate odor. Air freshener is only released from the toilet seat through pressure applied to the seat or by manually turning on a switch. There is not a continuous flow of air freshener in the toilet area.

U.S. Pat. No. 3,914,805 issued to Dolan discloses a room deodorizing device adapted to be mounted on a flush tank of a toilet which even though it addresses the issue of a continuous flow of air freshener into the area surrounding the toilet, the apparatus used to hold the deodorant is suspended outside of the toilet tank which may have a negative impact on the appearance of the toilet.

U.S. Pat. No. 3,068,492 to Price discloses an apparatus for attaching an atomizer deodorant can to the outside of a toilet tank to be actuated whenever the flush handle is depressed. An inherent disadvantage here is the location of the deodorant apparatus which is visible and perhaps unsightly to the user.

U.S. Pat. No. 4,212,089 to Lindauer teaches a deodorizing process which utilizes an apparatus which contains a timing means for the intermittent release of deodorant from the apparatus for a predetermined time after each flushing. Releasing air freshener is dependent on the flushing operation of a toilet resulting in air freshener not being released on a continuous basis.

All of the stated patents disclose devices which have the disadvantages that either they operate on time cycles and/or on actuating some part of the toilet seat, lid, or flush tank which doesn't quite solve the problem of eliminating odor laden air which still exists in the toilet area after the exhaustion of the periodic releases of air freshener. Some of these devices which are battery operated or use an external voltage to energize the device are complicated and subject to malfunction. Air fresheners that hang in the toilet bowl or are attached to some object in the toilet area may be breakable and possess a cutting hazard or could be ingested by small children.

SUMMARY OF THE INVENTION

In view of some of the disadvantages inherent in prior art air freshening devices for toilet areas the object of the present invention is to provide an alternative to toilet deodorizers which hang in the toilet bowl or other air freshening devices which can be attached in the toilet area in a visible location or to complicated ventilating and odor filtering devices which are located in or around the toilet seat or area.

Another object of the present invention is to provide a novel air freshening cushioned toilet seat which retains the advantages of a freshener contained in the toilet seat and lid and is not visible to user.

Still another object of the invention is that air freshener is released continuously from the interior cushioning of the toilet seat through a plurality of holes on the seat located where contact with human skin is not made upon release of the air freshener.

A further object of the invention is that air freshener is released continuously and not in response to actuation of some part of the toilet seat, lid, or flush tank.

Yet another object of the invention is to have a continuous minimum concentration of air freshener in the toilet area at all times and to release a larger concentration when the toilet seat is used.

These disadvantages and others are overcome by the instant invention which employs a cushioned toilet seat and or lid using a reinforced foam interior covered by a plastic skin which is penetrated by at least one hole, and preferably a series of holes, through the skin into the interior of the foam. The freshener medium is located within these holes so that it can easily be replenished with air freshening agent. Where a series of holes is used, these are of relatively small diameter and are charged and recharged by impregnating the holes in the toilet seat by means of a container with an acicular head of specific length that penetrates through the holes on the seat through to the interior cushioning, where air freshening agent is deposited.

In another embodiment of the invention, a cavity coverable by a transparent lid is placed in the cushioning material within which an attractive (both in scent and in appearance) potpourri is placed.

These embodiments provide continuous odorous air freshening and/or decontaminating in a toilet area through a way which is economical and inconspicuous, which fits all conventional toilet bowls, and is low in maintenance, without mechanical complication and is affordable to all consumers.

A further object of the invention is to provide a cushioned toilet seat which can be recharged with new air freshener upon exhaustion of the original air freshener without disposing of the seat or any part thereof.

Other and further objects, advantages, and features of the present invention will be understood by reference to the following specifications in conjunction with the drawings, wherein like parts have been given like numbers.

BRIEF DESCRIPTION OF THE DRAWINGS

FIG. 15 is a perspective view of an upper panel containing a potpourri center with a lid made of transparent material covering the potpourri.

FIG. 16 is a sectional view through the upper lid shown in FIG. 15 taken on the line 16—16.

FIG. 17 is a bottom perspective view of the upper lid in FIG. 15.

FIG. 18 is an illustration of an alternate air freshener container with an acicular head of specific length.

LIST OF REFERENCE NUMERALS USED IN THE DRAWINGS

10—upper panel of toilet seat
12—lower panel of toilet seat
13—axis
14—outer covering of toilet seat panels
15—central opening in lower panel
16—holes on the toilet seat
18—rigid, reinforcing layer in interior of toilet seat panels
20—cushion layer
22—container for holding air freshener
24—specific length acicular head
26— deposit of air freshener in cushion layer
28—flush tank
30—toilet bowl
32—potpourri center or cavity
33—potpourri
34—transparent lid covering potpourri
36—planar lower surface of upper panel
38—peripheral edge of lower panel
100—toilet seat

DETAILED DESCRIPTION OF THE PREFERRED EMBODIMENT

Figure 1:
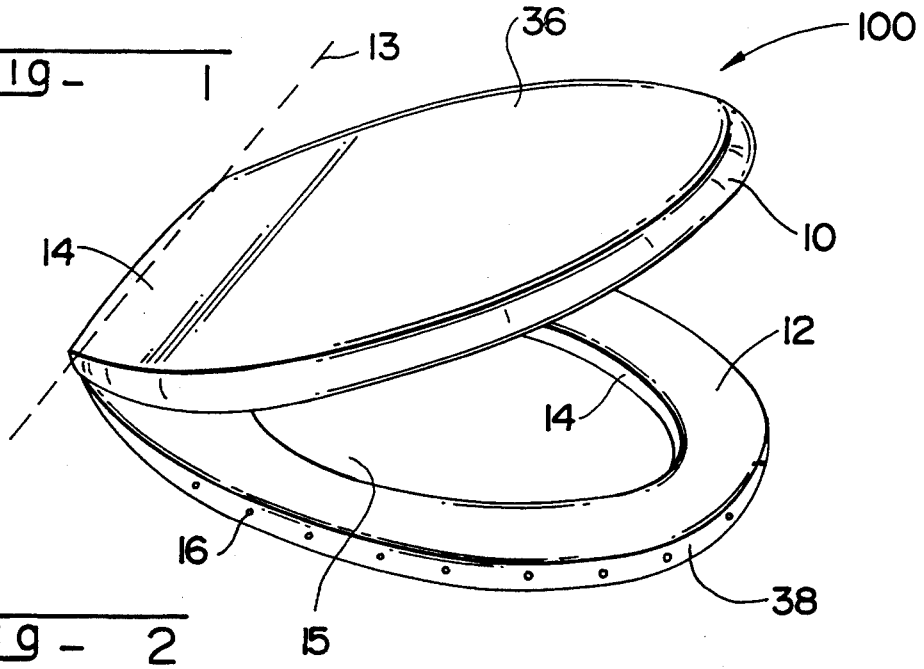
FIG. 1 is a plan view of a refreshable fragrant cushioned toilet seat showing the lower panel and the upper panel according to the invention.
Figure 2:
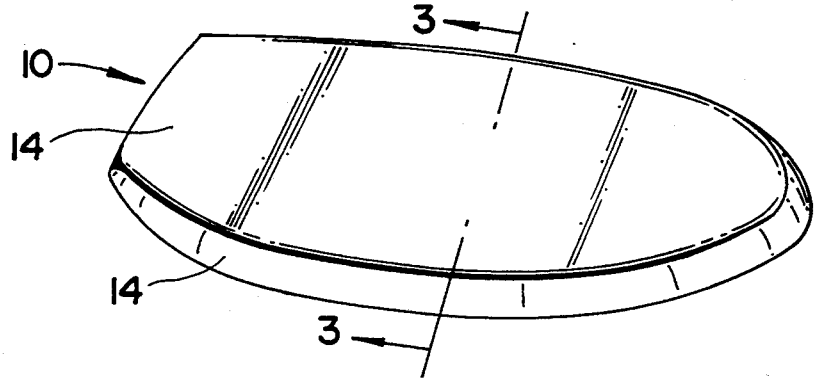
FIG. 2 is a top perspective view of a toilet seat upper panel used with the invention.
Figure 3:
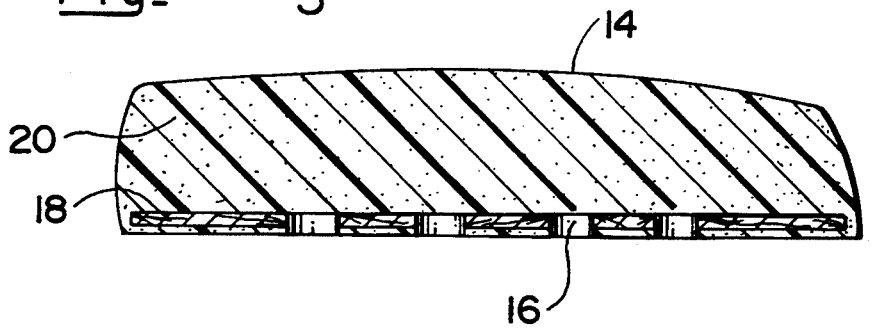
FIG. 3 is a sectional view through the upper panel of FIG. 2. taken on the line 3—3 of FIG. 1.
Figure 8:
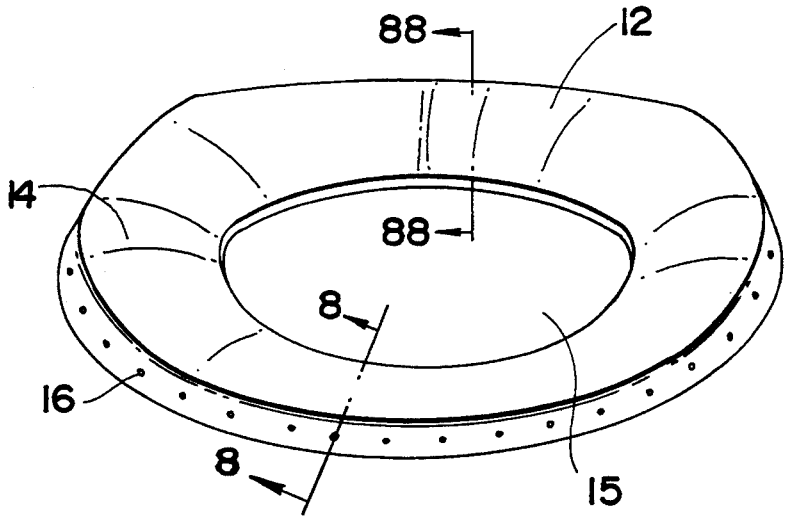
FIG. 8 is a top front view of the lower panel of a toilet seat.
Figure 9:
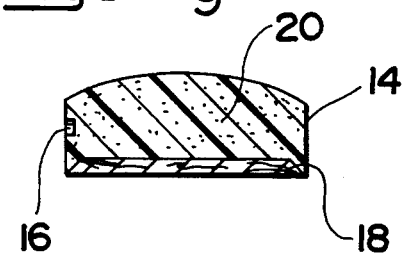
FIG. 9 is a sectional view of one side of the lower panel taken on the line 8—8 of FIG. 8.
Figure 10:
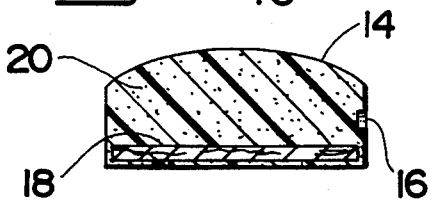
FIG. 10 is a sectional view of the other side of the lower panel taken on the line 88—88 of FIG. 8.
Figure 14:
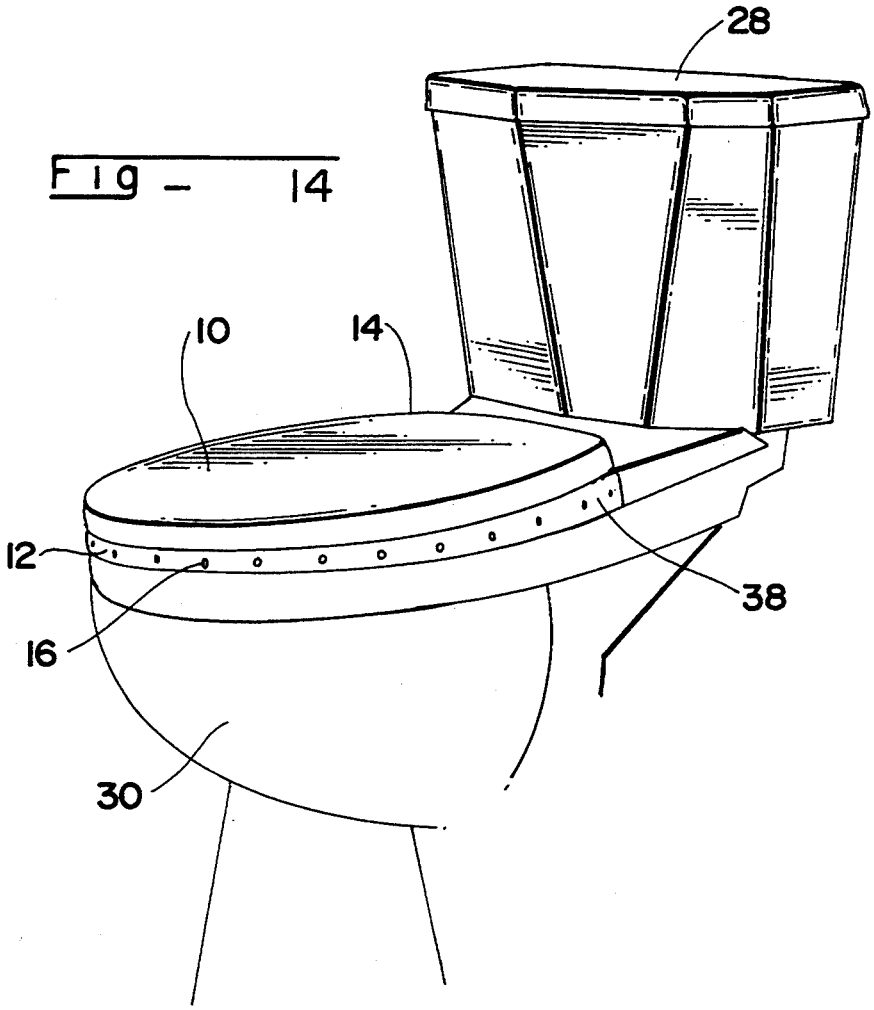
FIG. 14 is a full perspective view of the toilet seat with upper and lower panels in a lowered position.

FIG. 1 shows a cushioned, covered toilet seat 100 to fit a conventional toilet bowl with upper panel 10 and lower panel 12 which are mounted about a common horizontally extending axis 13 for swinging movement between their customary raised (see FIG. 11) and lowered positions (see FIG. 14). Details of the components of seat 100 are seen in FIGS. 2 through 10. As is customary, upper panel 10 lids lower panel 12 and is a substantially planar structure. which is used as a seat when lowered. As is also customary, lower panel, when upper panel 10 is raised, functions as a seat with a central opening 15. Lower panel 12 is substantially in the shape of a torus somewhat modified, elongated and flattened as is known, and as best seen in FIGS. 8, 9, and 10.

The panels are composed of like materials. FIGS. 3, 5, 9, and 10 illustrate the composition of both the upper panel 10 and the lower 12, which comprises outer covering 14 of a sheet material, film, fabric, coated fabric, leather or the like. A vinyl material, or other thermoplastic material, is preferred. The covering 14 is followed by a layer of rigid reinforcing material 18 shaped in the conventional shape of an upper and lower panel of a toilet seat. The rigid material 18 may be of chipboard, cork, wood, plastic or any another material which will meet the reinforcing requirement of holding the seat in structural integrity, keep the cost of manufacturing to a minimum, and provide a suitably comfortable seat for its user. Cushion layer 20, which may be any stuffing material, preferably is a foam material and particularly preferred is one of the flexible thermoplastic foams such as urethane, most particularly of the open cell variety, or the like. This takes the conventional shape of upper and lower panels of a toilet seat. These layers are mounted upon rigid reinforcing material 18; and a layer 14 of vinyl material or the like is used to cover at least the upper surface of the upper panel 10 and at least the lower surface of the lower panel 12 of the toilet seat 100. Preferably the entirety of the panels is covered. Layer 14 is pulled tautly downwards over the upper panel 10 and lower panel 12 and a bottom layer of vinyl 14 or the like is pulled tautly upwards over the upper panel 10 and lower panel 12 until both bottom and top layers of vinyl 14 or like material meet where they are then heat sealed together to complete the upper panel 10 and lower panel 12 of the cushioned toilet seat 100. Other methods may be used to seal the bottom and top layers of vinyl 14. This will depend on the material used to cover the toilet seat 100.

Figure 5:
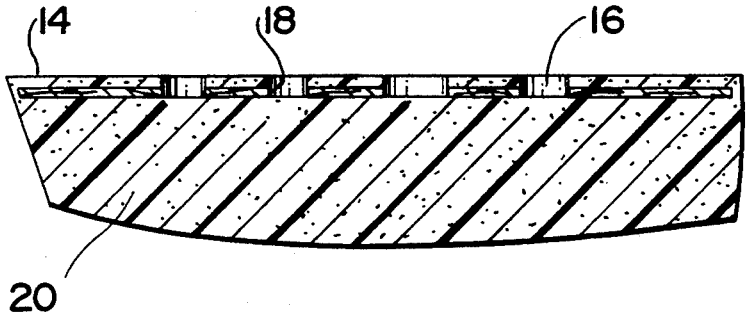
FIG. 5 is a sectional view through the upper panel of the toilet taken on the line 5—5 of FIG. 4.
Figure 6:
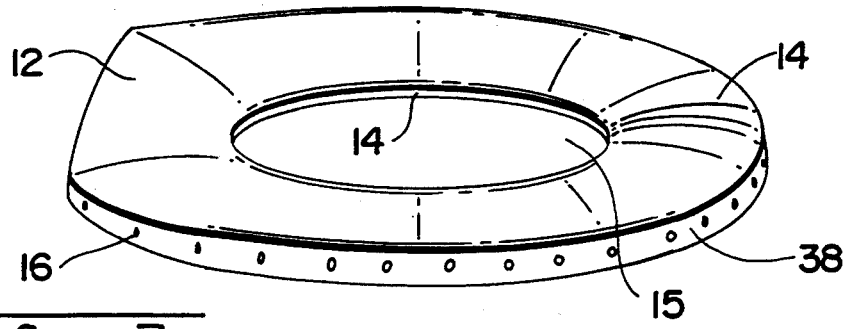
FIG. 6 is a top perspective view of the lower panel of the toilet seat.
Figure 7:
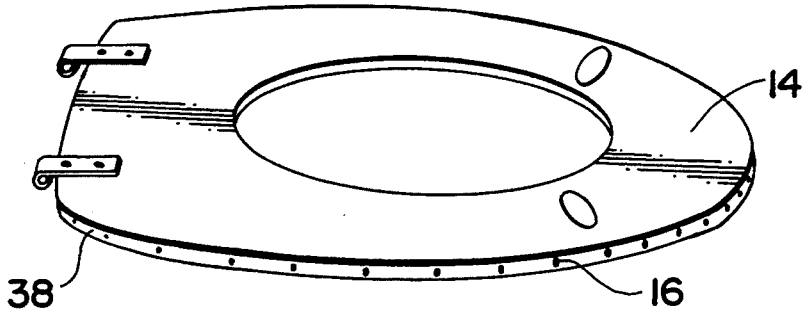
FIG. 7 is a bottom side perspective view of the lower panel of the toilet seat.
Figure 11:
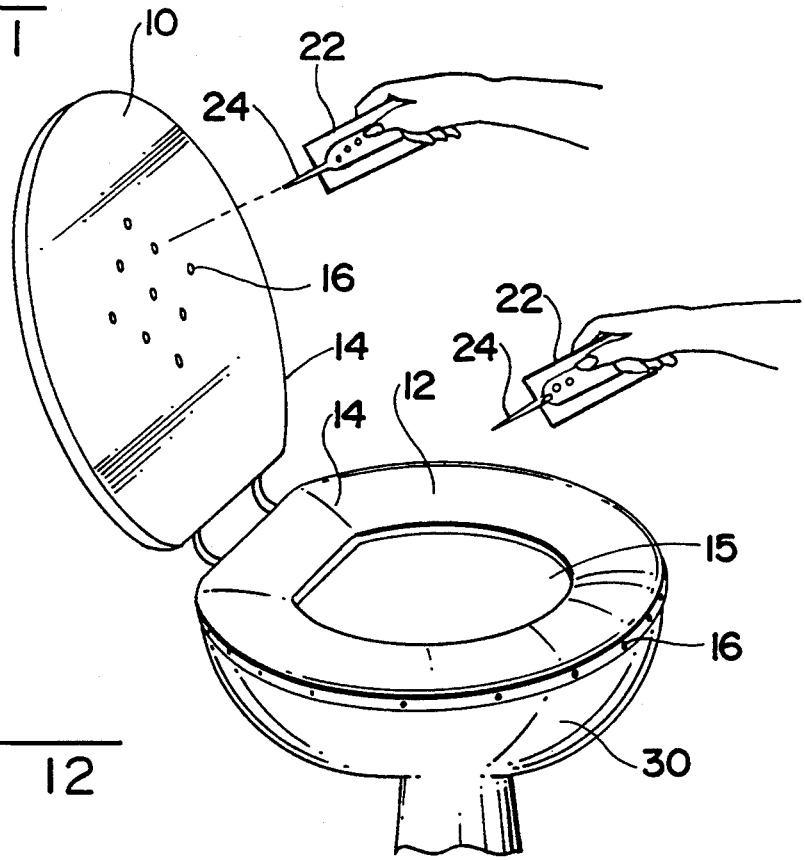
FIG. 11 is a full perspective view of the toilet seat of the invention and an associated toilet with an illustration of the means of replenishing the toilet seat with air freshener.
Figure 12:
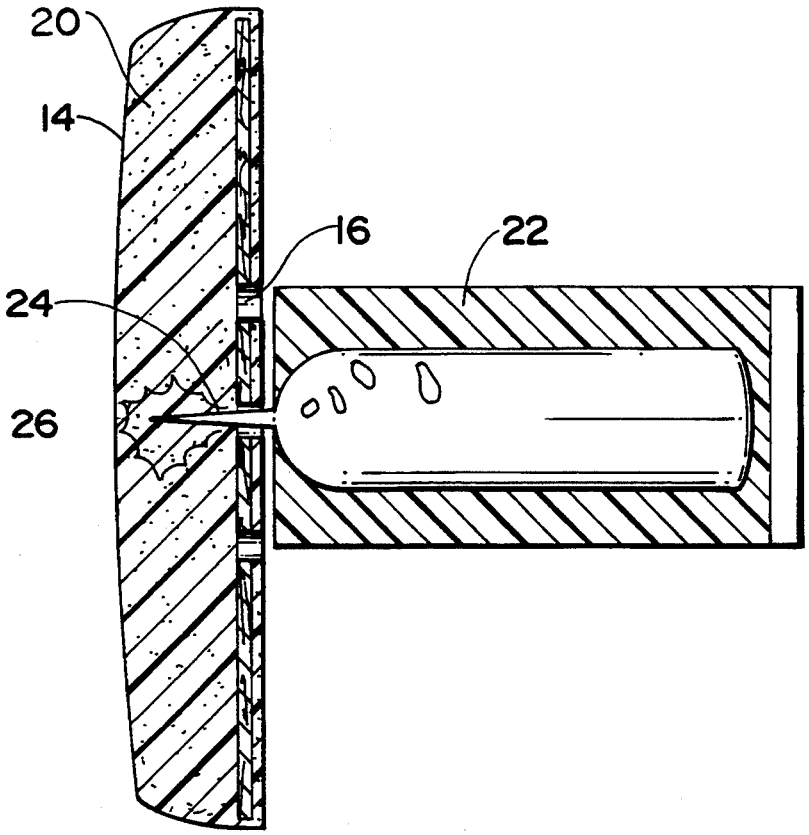
FIG. 12 shows the impregnation of the upper panel of the toilet seat with air freshener by a container with an acicular head of specific length.
Figure 13:
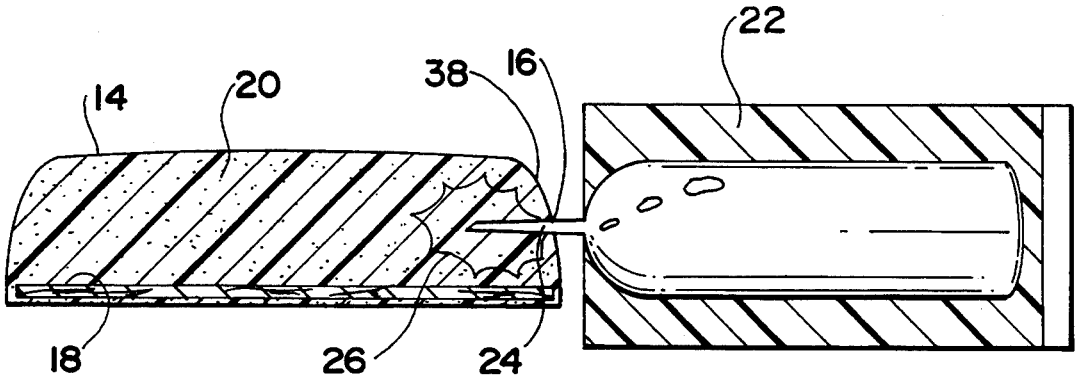
FIG. 13 shows the impregnation of the lower panel of the toilet seat with air freshener by a container with an acicular head of specific length.

Refer now to FIGS. 6 and 5. Holes 16 are drilled on the lower surface 36 (bottom side) of the upper panel which penetrate through to the rigid material 18 and in turn penetrate into cushion 20. It is preferred that holes 16 penetrate approximately half way through the cushion 20; holes 16 are also drilled on the lower panel 12 on the outer, peripheral edge 38 of lower panel 12 as well seen in FIG. 1. The upper panel 10 and lower panel 12 of the toilet seat can be replenished with air freshener by impregnating the toilet seat through the holes 16 by way of a dispensing container 22 with an acicular head 24 of an exact length to upper panel 10 penetrate halfway through into the cushion layer 20. This procedure is illustrated in FIGS. 11, 12, and 13. A squeeze container 22 is shown. However, other containers to discharge contents by a variety of means are well known and can be used provided the container is fitted with an acicular head as taught herein. A squeeze on the air freshener container 22 will deposit air freshening agent 26 onto the cushion layer 20 in the interior of upper panel 10 and lower panel 12.

The holes 16 provide for the release of air freshener by diffusion into the toilet area from the deposit of air freshener 26 established in the interior cushion layers 20 of the toilet seat 100 Air freshener is released more generously when pressure is applied to the lower panel 12 by the weight of a user seated on the toilet seat 100.

A number of dispensing containers 22 may be sold as a kit with the toilet seat 100 of this invention or they may be merchandised separately.

FIG. 14 illustrates that odors in the toilet bowl 30 are directly covered and neutralized when the upper panel 10 is in a lowered position as the holes 16 in lower panel 12 are not covered by the lowered upper panel 10 and continue to release fragrance by diffusion to the surroundings. Thus the refreshable, fragrant cushioned toilet seat 100 can be used not only as a comfortable toilet seat, but can also eliminate the need for other air freshening devices in the toilet area.

The invention may be embodied in other specific forms without departing from the spirit or essential characteristics of the invention.

One such is shown in FIGS. 15 and 16. A potpourri center 32 is formed on the top side of the upper panel 10. This is a cavity containing potpourri 33 with a transparent lid 34 flush with the top of upper panel 10. Potpourri 33 may be any of the known mixtures of dried flowers, other plant parts, spice and wood chips; all of which have pleasant odors and an attractive appearance. A fragrance is usually incorporated in such a mixture and may be renewed as pictured in FIG. 16 with a container 22 ejecting fragrance or the like into potpourri center 32 through acicular head 24.

Figure 4:
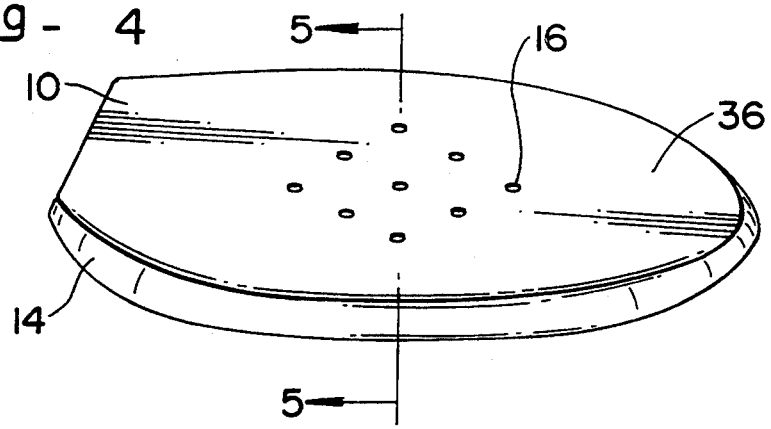
FIG. 4 is a bottom perspective view of the toilet seat upper panel.

The holes 16 on the parts of toilet seat 100 may take various decorative shapes and designs and various positions on the seat. FIG. 17 shows one such pattern on the top of upper panel 10. FIG. 4 shows another pattern which is located on the bottom of upper panel 10.

The container holding air freshening agent may be of different designs as mentioned above. One such is shown in FIG. 18 where for convenience of illustration only a single hole 16 is pictured.

Therefore the present embodiments are to be considered in all respects as illustrative and not restrictive, the scope of the invention being indicated by the appended claims.

What is claimed is:

1. A toilet seat (100) wherein said seat (100) has means for replenishably releasing fragranted air freshener (26) from within said seat (100) comprising:

an upper panel (10) comprising a rigid reinforcing layer (18) with an open cell cushion layer (20) thereon and an outer covering (14) enclosing said layers (18, 20) said upper panel (10) lidding a lower panel (12) and in hinged connection thereto about a common axis (13) said panels (10,12) further disposed for hinged connection to a toilet bowl (30);

said lower panel (12) comprising a rigid reinforcing layer (18) with an open cell cushion layer (20) thereon and an outer covering (14) enclosing said layers (18, 20) said lower panel (12) substantially toroidal in configuration and fitted for hinged connection with a toilet bowl (30); at least one hole (16) in at least one of said panels (10, 12); and replenishable fragranted air freshener (26) disposed within said cushion layer (20) whereby said freshener(26) is released by diffusion from said at least one hole (16) and by pressure when said at least one of said panels (10,12) is weighted by a user; in combination with a dispensing container (22) of fragranted air freshener (26) having an acicular head (24) of a length selected to penetrate the full depth of said at least one hole (16) for replenishing said air freshener (26) disposed within said cushion layer (20).

2. The toilet seat (100) of claim 1 wherein said at least one hole (16) penetrates said cushion layer (20) and said penetration is substantially half way through said cushion layer (20).

3. The toilet seat (100) of claim 1 wherein said covering (14) is a sheet material and wherein said sheet material is a thermoplastic material sealed to itself to enclose said layers (18, 20) and wherein said at least one hole (16) said covering (14).

4. The toilet seat (100) of claim 3 wherein there is a plurality of said holes (16).

5. A toilet seat (100) wherein said seat (100) has means for replenishably releasing fragranted air freshener (26) from within said seat (100) comprising:

an upper panel (10) comprising a rigid reinforcing layer (18) with an open cell cushion layer (20) thereon and an outer covering (14) enclosing said layers (18, 20) said upper panel (10) lidding a lower panel (12) and in hinged connection thereto about a common axis (13) said panels (10,12) further disposed for hinged connection to a toilet bowl (30); said lower panel (12) comprising: a rigid reinforcing layer (18) with an open cell cushion layer (20) thereon; an outer covering (14) enclosing said layers (18, 20), said lower panel (12) substantially toroidal in configuration and fitted for hinged connection with a toilet bowl (30); and at least one hole (16) in at least one of said panels (10, 12); and replenishable fragranted air freshener (26) disposed within said cushion layer (20) whereby said freshener 26) is released by diffusion from said at least one hole (16) and by pressure when said at least one of said panels (10,12) is weighted by a user and wherein said at least one hole (16) communicates with a cavity (32) in said upper panel (10), said cavity (32) is covered with a transparent lid (34) flush with the top of said upper panel (10), and said cavity is filled with replenishably fragranted potpourri (33).

6. The toilet seat (100) of claim 5 wherein there is a plurality of said holes (16).

7. The toilet seat (100) of claim 5 in combination with a dispensing container (22) of fragranted air freshener (26) having an acicular head (24) of a length selected to penetrate part way into said at least one hole (16) for replenishing said air freshener (26) disposed within said potpourri (33).

* * * * *